US008407054B2

(12) United States Patent
Kato et al.

(10) Patent No.: US 8,407,054 B2
(45) Date of Patent: Mar. 26, 2013

(54) SPEECH SYNTHESIS DEVICE, SPEECH SYNTHESIS METHOD, AND SPEECH SYNTHESIS PROGRAM

(75) Inventors: Masanori Kato, Tokyo (JP); Yasuyuki Mitsui, Tokyo (JP); Reishi Kondo, Tokyo (JP)

(73) Assignee: NEC Corporation, Tokyo (JP)

( * ) Notice: Subject to any disclaimer, the term of this patent is extended or adjusted under 35 U.S.C. 154(b) by 702 days.

(21) Appl. No.: 12/599,317

(22) PCT Filed: Apr. 28, 2008

(86) PCT No.: PCT/JP2008/058179

§ 371 (c)(1),
(2), (4) Date: Nov. 9, 2009

(87) PCT Pub. No.: WO2008/133919

PCT Pub. Date: Nov. 20, 2008

(65) Prior Publication Data

US 2010/0211393 A1 Aug. 19, 2010

(30) Foreign Application Priority Data

May 8, 2007 (JP) ..... 2007-123422

(51) Int. Cl.
*G10L 13/06* (2006.01)

(52) U.S. Cl. ..... 704/266

(58) Field of Classification Search ..... 704/258–269
See application file for complete search history.

(56) References Cited

U.S. PATENT DOCUMENTS 6,076,060 A * 6/2000 Lin et al. ..... 704/260
8,036,894 B2 * 10/2011 Neeracher et al. ..... 704/267
2003/0158734 A1 * 8/2003 Cruickshank ..... 704/260
2004/0059568 A1 * 3/2004 Talkin ..... 704/205

FOREIGN PATENT DOCUMENTS

JP 6-318094 A 11/1994
JP 2812104 B 8/1998
JP 2001117577 A 4/2001
JP 2002049386 A 2/2002

(Continued)

OTHER PUBLICATIONS

Gaura, Pavel; Czech speech synthesizer popokatepetl based on word corpus; Video/Image Processing and Multimedia Communications, 2003. 4th EURASIP Conference focused on Vo.2, Digital Object Identifier: 10.1109/VIPMC.2003.1220541 Publication Year: 2003 , pp. 673-678 vol. 2.*

(Continued)

*Primary Examiner* — Abdul Azad

(57) ABSTRACT

A speech synthesis device is provided with: a central segment selection unit for selecting a central segment from among a plurality of speech segments; a prosody generation unit for generating prosody information based on the central segment; a non-central segment selection unit for selecting a non-central segment, which is a segment outside of a central segment section, based on the central segment and the prosody information; and a waveform generation unit for generating a synthesized speech waveform based on the prosody information, the central segment, and the non-central segment. The speech synthesis device first selects a central segment that forms a basis for prosody generation and generates prosody information based on the central segment so that it is possible to sufficiently reduce both concatenation distortion and sound quality degradation accompanying prosody control in the section of the central segment.

18 Claims, 9 Drawing Sheets

FOREIGN PATENT DOCUMENTS

| | | | |
|---|---|---|---|
| JP | 2004138728 | A | 5/2004 |
| JP | 2005091551 | A | 4/2005 |
| JP | 2005265874 | A | 9/2005 |
| JP | 2005300919 | A | 10/2005 |
| JP | 2005321630 | A | 11/2005 |
| JP | 2006084854 | A | 3/2006 |

OTHER PUBLICATIONS

International Search Report for PCT/JP2006/058179 mailed Aug. 5, 2006.

X. Huang et al,. "Spoken Language Processing, A Guide to Theory, Algorithm and System Development", Prentice Hall, p. 689-836, 2001.

Y. Ishikawa, "Prosodic Control for Japanese Text-to-Speech Synthesis", The Institute of Electronics, Information and Communication Engineers, Technical Report, vol. 100, No. 392, pp. 27-34, 2000.

M. Abe et al., "An introduction to speech synthesis units", The Institute of Electronics, Information and Communication Engineers, Technical Report, vol. 100, No. 392, pp. 35-42, 2000.

E. Moulines et al., "Pitch-Synchronous Waveform Processing Techniques for Text-To-Speech Synthesis using Diphones", Speech Communication 9, pp. 453-467, 1990.

H. Segi et al., "A Concatenative Speech Synthesis Method Using Context Dependent Phoneme Sequences With Variable Length As Search Units", Proceedings of 5th ISCA Speech Synthesis Workshop, pp. 115-120, 2004.

H. Kawai et al., "XIMERA: A New TTS From ATR Based on Corpus-Based Technologies", Proceedings of 5th ISCA Speech Synthesis Workshop, pp. 179-184, 2004.

M. Kato et al., "High-Quality Speech Synthesis Based on Two-Stage Unit Selection", Mar. 10, 2008, 1-11-22, pp. 293-294.

* cited by examiner

SPEECH SYNTHESIS DEVICE, SPEECH SYNTHESIS METHOD, AND SPEECH SYNTHESIS PROGRAM

This application is the National Phase of PCT/JP2008/058179, filed Apr. 28, 2008, which is based upon and claims the benefit of the priority of Japanese patent application No. 2007-123422 (filed on May 8, 2007), the disclosure of which is incorporated herein in its entirety by reference thereto.

TECHNICAL FIELD

The present invention relates to a speech synthesis device, a speech synthesis method, and a speech synthesis program, and in particular, to a speech synthesis device, a speech synthesis method, and a speech synthesis program for synthesizing speech from text.

BACKGROUND ART

Heretofore, various types of speech synthesis devices have been developed for analyzing text and generating synthesized speech by rule synthesis from speech information indicated by the text.

FIG. 9 is a block diagram showing a configuration of a conventional general rule synthesis type of speech synthesis device.

Details of configuration and operation of a speech synthesis device having this type of configuration are described, for example, in Non-Patent Documents 1 to 3 and in Patent Documents 1 and 2.

The speech synthesis device shown in FIG. 9 is provided with a language processing unit 10, prosody generation unit 11, segment selection unit 16, speech segment information storage unit 15, and waveform generation unit 17 that has prosody control unit 18 and waveform concatenation unit 19.

Speech segment information storage unit 15 has speech segment storage unit 152 that stores speech segments generated for each speech synthesis unit, and associated information storage unit 151 that stores associated information of each speech segment.

Here, the speech segments are often extracted from recorded natural speech waveforms, with information used for generating a waveform of synthesized speech. A speech waveform itself that has been clipped for each synthesis unit, or a linear prediction analysis parameter, cepstrum coefficient, or the like, may be cited as speech segment examples.

Furthermore, the associated information of a speech segment includes prosody information or phonology information such as phoneme environment of natural speech that is a source of extraction of each speech segment, pitch frequency, amplitude, duration time information, and the like.

In conventional speech synthesis devices, phonemes, CV, CVC, VCV (V is a vowel, C is a consonant) and the like are often used as the speech synthesis units. Details of length of these speech segments and synthesis units are described in Non-Patent Documents 1 and 3.

Language processing unit 10 performs morphological analysis, parsing, attachment of reading, and the like, with regard to inputted text, and outputs a symbol string representing a "reading" of a phonemic symbol or the like, a morphological part of speech, a conjunction, accent type or the like, as language processing results, to prosody generation unit 11 and segment selection unit 16.

Prosody generation unit 11 generates prosody information (information concerning pitch, time length, power, and the like) for the synthesized speech, based on the language processing results outputted from language processing unit 10, and outputs the generated prosody information to segment selection unit 16 and prosody control unit 18.

Segment selection unit 16 selects speech segments having a high degree of conformity with the language processing results and the generated prosody information, from among speech segments stored in speech segment information storage unit 15, and outputs the speech segments in conjunction with associated information of the selected speech segments to prosody control unit 18.

Prosody control unit 18 generates a waveform having a prosody close to a prosody generated by prosody generation unit 11, from the selected speech segments, and outputs to waveform concatenation unit 19.

Waveform concatenation unit 19 concatenates the speech segments outputted from the prosody control unit 18 and outputs the concatenated speech segments as synthesized speech.

Segment selection unit 16 obtains information (termed "target segment context" in the following) representing characteristics of target synthesized speech, from the inputted language processing results and the prosody information, for each prescribed synthesis unit.

The following may be cited as information included in the target segment context: respective phoneme names of a phoneme in question, a preceding phoneme, and a subsequent phoneme; presence or absence of stress; distance from accent core; pitch frequency and power for synthesis unit, continuous time length of unit, cepstrum, MFCC (Mel Frequency Cepstrum coefficients), and Δ amount thereof (change amount per unit time).

Next, when a target segment context is given, segment selection unit 16 selects a plurality of speech segments matching specific information (mainly the phoneme in question) designated by the target segment context, from within speech segment information storage unit 15. The selected speech segments form candidates for speech segments used in synthesis.

Then, "cost", which is an index indicating suitability as speech segments used in the synthesis, is computed for the selected candidate segments.

Since generation of synthesized speech of high sound quality is an object, if the cost is small, that is, suitability level is high, the sound quality of the synthesized sound is high.

Therefore, the cost may he said to be an indicator for estimating degradation of sound quality of the synthesized speech.

Here, the cost computed by segment selection unit 16 includes unit cost and concatenation cost.

The unit cost represents estimated sound quality degradation produced by using candidate segments based on the target segment context. The cost is computed based on degree of similarity of the segment context of the candidate segments and the target segment context.

On the other hand, concatenation cost represents estimated sound quality degradation level produced by a segment context between concatenated speech segments being non-continuous. The cost is computed based on affinity level of segment contexts of adjacent candidate segments.

Various types of proposal for methods of computing unit costs and concatenation costs have been made heretofore.

In general, information included in the target segment context is used in the computation of the unit cost; and pitch frequency, cepstrum, MFCC, short time autocorrelation, power, Δ amount thereof, and the like, with regard to a concatenation boundary of a segment, are used in the concatenation cost.

In a case where a certain two segments are continuous in an original speech waveform, since the segment context between these segments is completely continuous, the continuous cost value is zero.

Furthermore, in a case where segments of synthesized unit length are continuous in the original speech waveform, these continuous segments are represented as "segments of long segment length".

Therefore, it may be said that the larger the number of continuous occurrences, the longer the segment length will be. On the other hand, shortest segment length corresponds to synthesis unit length.

The concatenation cost and the unit cost are computed for each segment, and then a speech segment, for which both the concatenation cost and the unit cost are minimum, is obtained uniquely for each synthesis unit.

Since a segment obtained by cost minimization is selected as a segment that best fits speech synthesis from among the candidate segments, it is referred to as an "optimum segment".

Segment selection unit 16 obtains respective optimal segments for all synthesis units, and finally outputs a sequence of optimal segments (optimal segment sequence) as a segment selection result to prosody control unit 18.

With regard to segment selection unit 16, as described above, speech segments having a small unit cost are selected.

However, speech segments having a prosody close to a target prosody (prosody information included in the target segment context) are selected, but it is rare for a speech segment having a prosody equal to the target prosody to be selected.

Therefore, in general, after the segment selection, in prosody control unit 18, a speech segment waveform is processed to make a correction so that the prosody of the speech segment matches the target prosody.

As a method of correcting the prosody of the speech segment, a method using an analysis method disclosed in Patent Document 4, for example, is cited.

According to the analysis method of Patent Document 4, plural cepstrums representing a spectrum envelope of the original speech waveform are obtained, and by driving a filter representing the plural cepstrums at a time interval corresponding to a desired pitch frequency, it is possible to reconfigure speech waveform having the desired pitch frequency.

In addition, a PSOLA method described in Non-Patent Document 4 may be cited.

However, the prosody correction processing is a cause of degradation of synthesized speech. In particular, variations in pitch frequency have a large effect on sound quality degradation, and the larger the variation amount, the larger the sound quality degradation becomes.

On this account, if unit selection is performed with a criterion such that the sound quality degradation accompanying the prosody correction processing becomes sufficiently small (unit cost emphasis), segment concatenation distortion becomes conspicuous.

On the other hand, if segment selection is performed with a criterion such that the concatenation distortion becomes sufficiently small (concatenation cost emphasis), sound quality degradation accompanying prosody control becomes conspicuous.

Consequently, as a method of preventing the concatenation distortion and the sound quality degradation accompanying prosody control at same time, a method is considered in which various types of prosody information are prepared and unit selection is carried out, and a combination of a prosody and a unit selection result is selected so that sound degradation is minimized.

For example, Patent Document 3 proposes a method of repeating a frequency-directed parallel shift for a generated pitch pattern, and computation of unit selection score with the pitch pattern after the parallel shift as an target, and obtaining a parallel shift amount and unit selection result in which unit selection cost is smallest.

Furthermore, Non-Patent Document 5 proposes a method of firstly obtaining a combination of segments in which concatenation distortion is small, and of selecting a unit best fitting a target prosody from among them.

Furthermore, Non-Patent Document 6 proposes a method of selecting segments with maximizing of similarity with the target prosody and minimizing of concatenation distortion as criteria, and by generating synthesized speech without performing prosody control, concatenation distortion is reduced while preventing sound degradation accompanying prosody control.

[Patent Document 1]
JP Patent Kokai Publication No. JP-P2005-91551A
[Patent Document 2]
JP Patent Kokai Publication No. JP-P2006-84854A
[Patent Document 3]
JP Patent Kokai Publication No. JP-P2004-138728A
[Patent Document 4]
JP Patent No. 2812184
[Non-Patent Document 1]
Huang, Acero, Hon: "Spoken Language Processing," Prentice Hall, pp. 689-836, 2001.
[Non-Patent Document 2]
Ishikawa: "Fundamentals of Prosody Control for Speech Synthesis," The Institute of Electronics, Information and Communication Engineers, Technical Report, Vol. 100, No. 392, pp. 27-34, 2000.
[Non-Patent Document 3]
Abe: "Fundamentals of Synthesis Units for Speech Synthesis," The Institute of Electronics, Information and Communication Engineers, Technical Report, Vol. 100, No. 392, pp. 35-42, 2000.
[Non-Patent Document 4]
Moulines, Charapentier: "Pitch-Synchronous Waveform Processing Techniques For Text-To-Speech Synthesis Using Diphones," Speech Communication 9, pp. 453-467, 1990.
[Non-Patent Document 5]
Segi, Takagi, Ito: "A Concatenative Speech Synthesis Method Using Context Dependent Phoneme Sequences With Variable Length As Search Units," Proceedings of 5th ISCA Speech Synthesis Workshop, pp. 115-120, 2004.
[Non-Patent Document 6]
Kawai, Toda, Ni, Tsuzaki, Tokuda: "XIMERA: A New TTS From ATR Based On Corpus-Based Technologies," Proceedings of 5th ISCA Speech Synthesis Workshop, pp. 179-184, 2004.

SUMMARY

Matter disclosed by the abovementioned Patent Documents 1 to 4, and Non-Patent Documents 1 to 6 is incorporated herein by reference thereto. An analysis of technology related to the present invention is given below.

Conventional speech synthesis devices described in the abovementioned patent documents and non-patent documents have the following problems.

First, in the method described in Patent Document 3, since target prosody variation is limited, there has been a problem in that it is difficult to select a combination of segments in which concatenation distortion is sufficiently small, and significant improvement in sound quality cannot be anticipated.

Furthermore, a method of Non-Patent Document 5 is effective in reducing concatenation distortion, but there has been a problem in that segments that are suitable with regard to prosody are not found due to a shortage of candidates, and sound degradation accompanying prosody control becomes large.

Furthermore, a method of Non-Patent Document 6 is effective in sufficiently reducing both concatenation distortion and sound quality degradation accompanying prosody control, but there has been a problem in that, since no prosody control at all is performed, prosody of synthesized speech is easily disturbed.

Therefore, in the speech synthesis devices described in the patent documents and the non-patent documents, there have been problems in that it is difficult to generate synthesized speech having little prosody disturbance, while sufficiently reducing both concatenation distortion and sound quality degradation accompanying prosody control.

The present invention is made in light of the abovementioned problems, and it is an object of the invention to provide a speech synthesis device, a speech synthesis method, and a speech synthesis program that can generate synthesized speech having little prosody disturbance, while sufficiently reducing both concatenation distortion and sound quality degradation accompanying prosody control.

According to a first aspect of the present invention, a speech synthesis device comprises:

a central segment selection unit for selecting a central segment from among a plurality of speech segments;

a prosody generation unit for generating prosody information based on the central segment;

a non-central segment selection unit for selecting a non-central segment, which is a segment outside of a central segment section, based on the central segment and the prosody information; and a waveform generation unit for generating a synthesized speech waveform based on the prosody information, the central segment, and the non-central segment.

According to a second aspect of the present invention, a speech synthesis method includes:

selecting a central segment from among a plurality of speech segments;

generating prosody information based on the selected central segment;

selecting a non-central segment, which is a segment outside of a central segment section, based on the central segment and the prosody information; and generating a synthesized speech waveform based on the prosody information, the central segment, and the non-central segment.

According to a third aspect of the present invention, a speech synthesis program for a speech synthesis device causes a computer to function as:

a central segment selection unit for selecting a central segment from among a plurality of speech segments;

a prosody generation unit for generating prosody information based on the central segment;

a non-central segment selection unit for selecting a non-central segment, which is a segment outside of a central segment section, based on the central segment and the prosody information; and a waveform generation unit for generating a synthesized speech waveform based on the prosody information, the central segment, and the non-central segment.

According to the present invention, a speech synthesis device first selects beforehand a central segment that forms a basis for prosody generation with respect to an arbitrary section, and generates prosody information based on the central segment so that it is possible to sufficiently reduce both concatenation distortion and sound quality degradation accompanying prosody control in the section of the central segment.

Furthermore, in a section in which a central segment has not been selected, since a segment fitting the prosody information generated based on the central segment is selected, it is possible to reduce disturbance of prosody of synthesized speech.

Thus, it is possible to realize a speech synthesis device, a speech synthesis method, and a speech synthesis program that can generate synthesized speech having little prosody disturbance, while sufficiently reducing both concatenation distortion and sound quality degradation accompanying prosody control.

Explanations of symbols are given in the text.

PREFERRED MODES

Next, a detailed description is given concerning configurations of exemplary embodiments of the present invention, making reference to the drawings.

Figure 1:
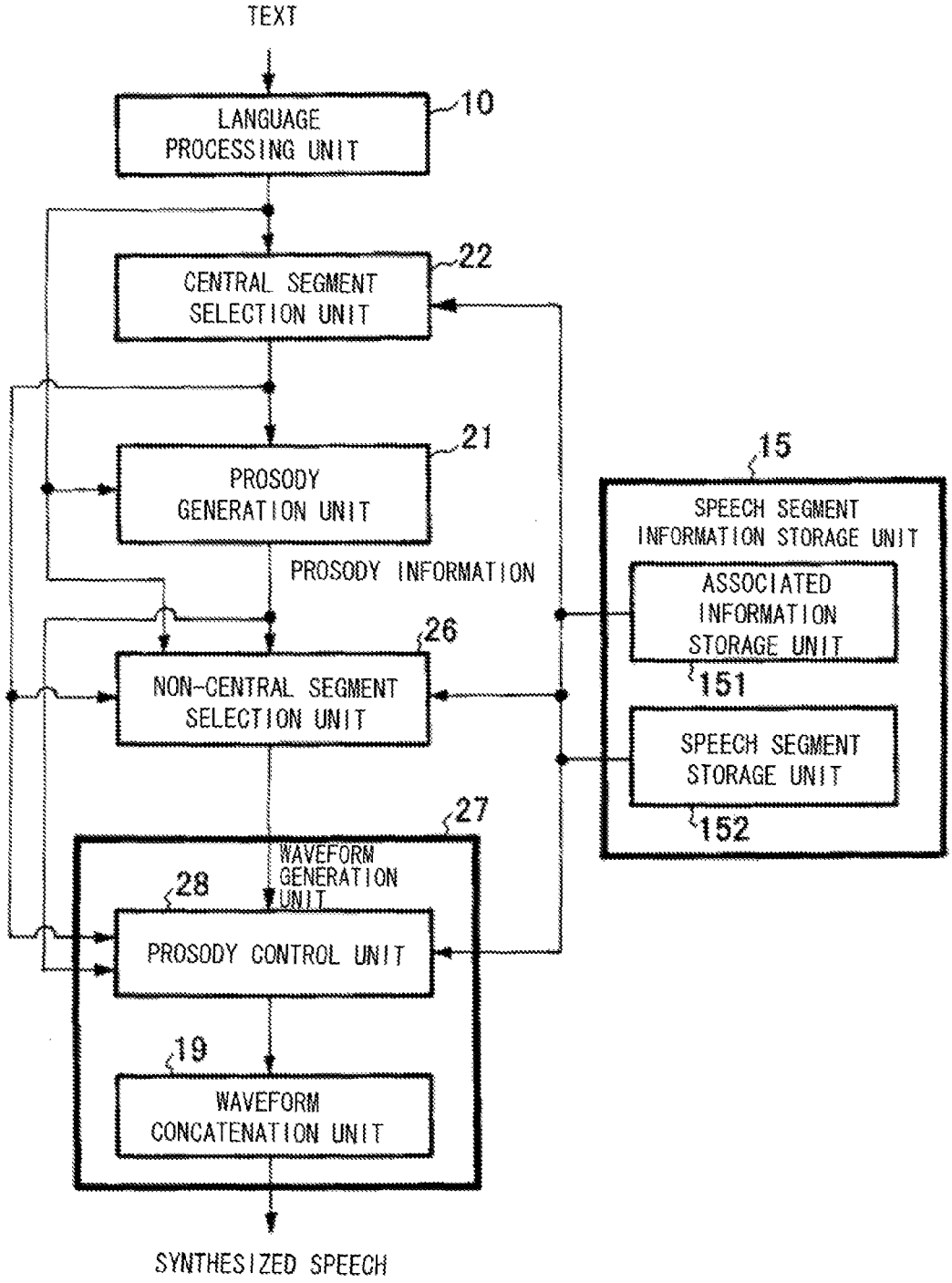
FIG. 1 is a block diagram showing a configuration of a speech synthesis device according to a first exemplary embodiment of the present invention.

(1) Speech Synthesis Device according to a First Exemplary Embodiment (1-1) Configuration of a Speech Synthesis Device According to the First Exemplary Embodiment FIG. 1 is a block diagram showing a configuration according to the first exemplary embodiment of the present invention.

Figure 9:
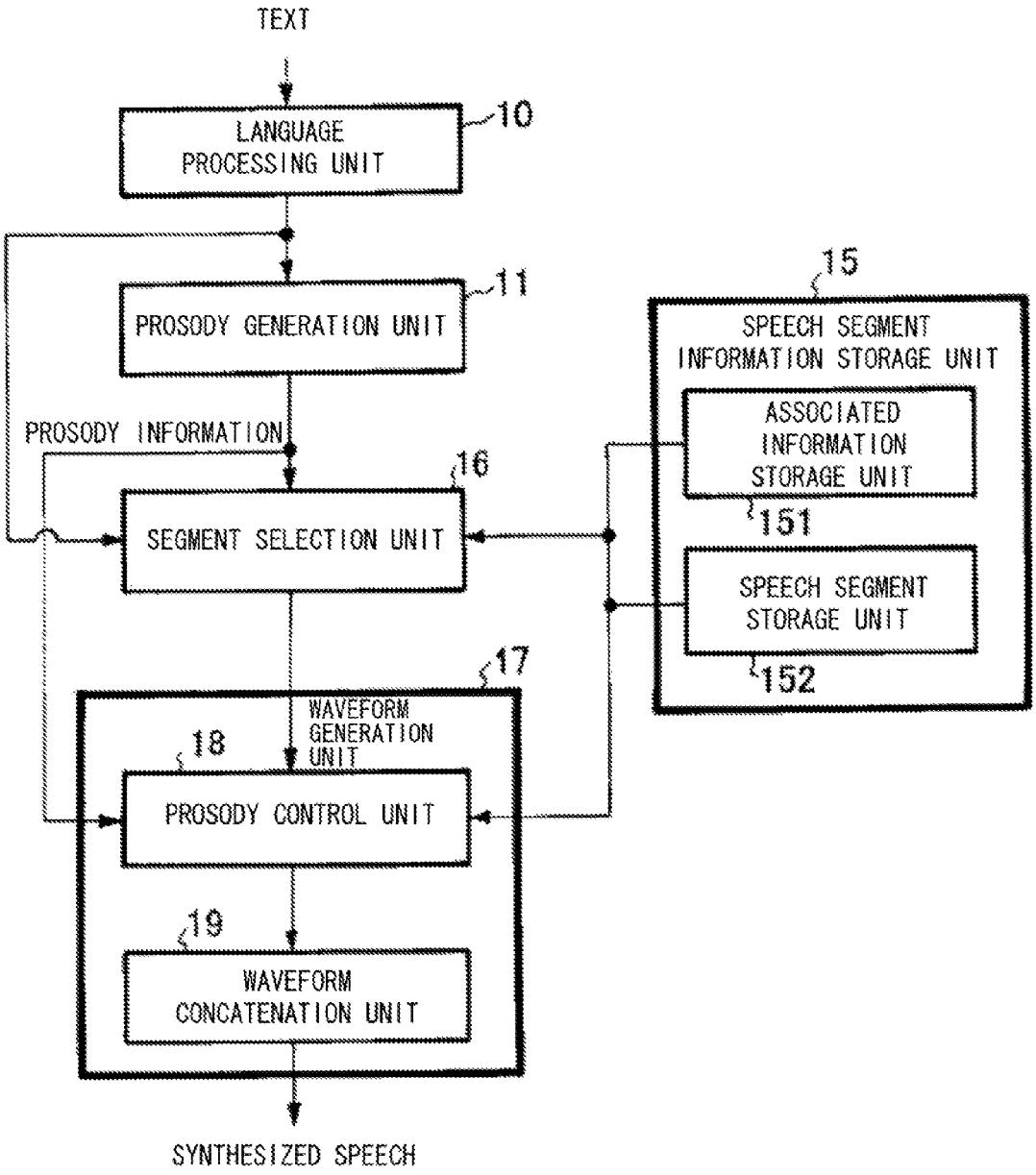
FIG. 9 RELATED ART
FIG. 9 is a configuration diagram showing an example of a conventional general rule-based synthesis type of speech synthesis device.

The configuration of the present exemplary embodiment shown in FIG. 1, in comparison to FIG. 9, which is a conventional block diagram described with regard to prior technology, is characterized by being provided with prosody generation unit 11, and instead of segment selection unit 16 and prosody control unit 18, prosody generation unit 21, central segment selection unit 22, non-central segment selection unit 26, and prosody control unit 28.

Focusing on these points of difference, a description is given below concerning detailed operation of a speech synthesis device according to the first exemplary embodiment, while referring to the block diagram of FIG. 1.

Figure 2:
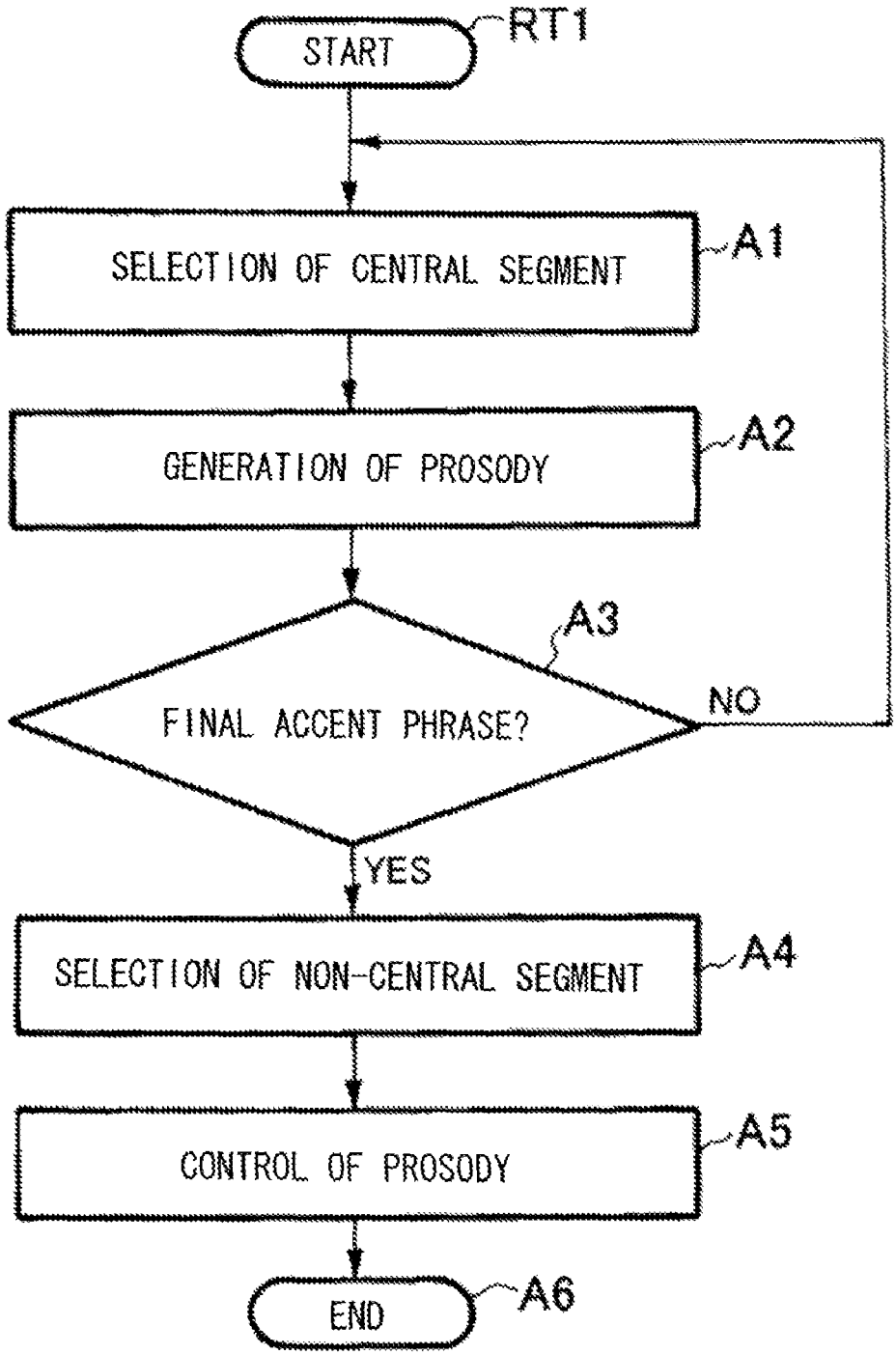
FIG. 2 is a flowchart for describing operation according to a first exemplary embodiment of the present invention.

(1-2) Operation of a Speech Synthesis Device According to the First Exemplary Embodiment FIG. 2 is a flowchart for describing operation of the first exemplary embodiment of the present invention.

Referring to the flowchart of FIG. 2, central segment selection unit 22 selects a central segment based on speech segment information supplied from speech segment information storage unit 15, for an arbitrary section (for example, an accent phrase, a breath group, or the like) among language processing results supplied from language processing unit 10, and transmits information concerning the selected central segment to prosody generation unit 21, non-central segment selection unit 26, and prosody control unit 28 (step A1).

Here, by showing a segment used to generate the prosody information in prosody generation unit 21 in a later stage, distinction from general segments is realized and the segment is referred to as a central segment with regard to the section in question. If segments have an identical reading, an arbitrary segment can be used for the central segment, but there exist several desirable conditions in achieving high sound quality.

Therefore, in the present exemplary embodiment, a description is given concerning an example of selecting a longest segment as the central segment from among those having high degree of conformity with a language processing result.

The degree of conformity with the language processing result is defined as a matching level of respective language information of input text and speech content of speech waveform stored in speech segment information storage unit 15.

Specifically, besides the reading, matching level of preceding and subsequent phonemes, position in accent phrase, relative position from accent nucleus, part of speech information, and the like, form a conformity degree indicator.

For example, if "ha" of "hashiru" (run) and "ha" of "hashi" (chopsticks) are compared, subsequent phonemes match, but since accent forms of "hashiru" and "hashi" differ, relative positions with respect to the accent nucleus are different.

On the other hand, if "ha" of "hashiru" (nm) and "ha" of "hashi" (bridge) are compared, subsequent phonemes and relative positions with respect to the accent nucleus match.

Therefore, in this example, it may be said that with regard to the "ha" of "hashiru" (nm), the "ha" of "hashi" (bridge) has a higher matching level with respect to language information than the "ha" of "hashi" (chopsticks).

Furthermore, "length of segment" described in the present exemplary embodiment is defined as the number of consecutive segments of synthesis unit length in an original speech waveform stored in speech segment information storage unit 15.

In general, speech segments are used for each synthesis unit, but consecutive segments in the original speech waveform are also used.

For example, with a synthesis unit as a syllable, when original speech waveforms of speech content of "haha" (mother), "shishi" (lion), and "hashi" (bridge) are stored in speech segment information storage unit 15, a case is envisaged in which input text of "hashiru" (nm) is given.

In forming the "hashi" of "hashiru" (nm), respective segments "ha" of "haha" (mother) and "shi" of "shishi" (lion) can be used, but, on the other hand, segments "ha" and "shi" of "hashi" (bridge), that is, segment "hashi", can be used. From the definition of segment length, the length of the segments "ha" and "shi" is one, and the length of the segment "hashi" is two.

Therefore, with only segment length as a selection criterion for a central segment, the segment "hashi" (bridge) is selected for the input text of "hashiru" (nm).

The higher the degree of conformity with a language processing results, the more difficult it becomes to select a long segment, so that it is desirable to use the degree of conformity with the language processing result as a constraint condition in selection of the central segment.

Furthermore, in a case where even the longest segment thereof is short, there is an adverse effect on prosody generation (for pitch pattern, a markedly unnatural pattern is generated).

Therefore, in a case where a segment fulfilling a length criterion does not exist, a central segment is not selected, and the fact that a central segment has not been selected is notified to prosody generation unit 21 and non-central segment selection unit 26.

On the other hand, in a case where plural longest segments appear, a method of making a selection including linguistically important locations is effective.

For example, selections in which positions of the accent nucleus are the same, or where there is an end of a sentence or an end of breath group, selections including these are selected preferentially.

Prosody generation unit 21 generates prosody information based on language processing results supplied by language processing unit 10 and a central segment supplied by central segment selection unit 22, to be transmitted to non-central segment selection unit 26 and prosody control unit 28 (step A2).

Here, in a section where the central segment exists (termed central segment section in the following), prosody information is generated such that prosody similar to prosody of the central segment is realized. In order to minimize sound quality degradation accompanying prosody control, it is most desirable that the generated prosody and the prosody of the central segment completely match.

However, if consideration is given to prosody balance of the whole text, there are cases where a complete match is not appropriate.

Therefore, in a range in which sound quality degradation accompanying prosody control is not conspicuous, a method of performing prosody transformation, such as a frequency-directed parallel shift in a case of a pitch pattern, and time-directed expansion and contraction in a case of time length, is effective.

Furthermore, an object of generating prosody similar to the prosody of the central segment is to reduce sound quality degradation accompanying prosody control of the central segment, so that it is best to avoid generating prosody information that differs largely from the prosody of the central segment.

On the other hand, in a section in which a central segment does not exist (termed non-central segment section in the following), prosody information is generated based on the language processing result.

On this occasion, when the respective prosodies of the central segment section and the non-central segment section differ largely, naturalness of the prosody is greatly impaired, so that it is necessary to generate the prosody information of the non-central segment section to match the prosody of the central segment section generated beforehand.

As an example of a method of generating the prosody information of the non-central segment section, a method is cited of first generating prosody information including the central segment section from language processing results, and then replacing the prosody information of the central segment section with that of the central segment.

Since a prosody mismatch occurs with a simple replacement, adjustment processing is necessary after the replacement.

As an example of adjustment processing, in a case of a pitch pattern, a method of transforming the pitch pattern so that the pattern becomes smooth is cited.

With regard to a method of generation prosody information from the language processing results, a method, widely and generally used heretofore, as described in Non-Patent Documents 1 or 3, may be employed.

In a case where it has been notified that a central segment has not been selected from the central segment selection unit 22, the prosody information is generated from only the language processing results in a similar manner as in prosody generation unit 11 of FIG. 9.

The selection of the central segment and the generation of the prosody information as above are performed for each arbitrary section. In the present exemplary embodiment, a description is given concerning an example using an accent phrase as the section.

Therefore, before moving to selection of the non-central segment, completion of selection of the central segment (step A1) and of generation of the prosody information (step A2) with regard to all accent phrases is confirmed (step A3).

Non-central segment selection unit 26 selects a segment of a non-central section based on language processing results supplied by language processing unit 10, the prosody information supplied by prosody generation unit 21, and the central segment information supplied from central segment selection unit 22 and transmits the segment to prosody control unit 21 (step A4).

In the selection of the non-central segment, similarly to a conventional method, unit cost and concatenation cost are computed, and a segment sequence for which both of these are minimum is selected.

The computation of the unit cost is performed for a non-central segment section, and the computation of the concatenation cost is performed in a non-central segment section and a boundary of the central segment section and the non-central segment section.

Since segment selection is already finished for the central segment section, the computation of the unit cost and the concatenation cost is unnecessary.

In a case where it has been notified that a central segment has not been selected by central segment selection unit 22, since an accent phrase for which a central segment has not been selected is equivalent to configuring with only a non-central segment section, the unit cost and the concatenation cost are computed for all the sections in question.

Prosody control unit 28 controls prosody of each segment, based on prosody information supplied by prosody generation unit 21, the central segment information supplied by central segment selection unit 22, and the non-central segment information supplied by non-central segment section unit 26, and supplies a segment whose prosody is corrected to a target prosody to waveform concatenation unit 19 (step A5).

Control of prosody may be implemented by a method similar to a conventional technique, without distinguishing between central segment and non-central segment.

(1-3) Effects of a Speech Synthesis Device According to the First Exemplary Embodiment According to the present exemplary embodiment, the speech synthesis device selects a segment with a long segment length as the central segment that forms a basis for prosody generation, and generates the prosody information based on the selected central segment.

A segment fitting the generated prosody information is selected.

As a result, since prosody information is generated based on this segment, in a section in which the central segment is selected, sound quality degradation accompanying prosody control is sufficiently reduced and hardly any concatenation distortion occurs.

In particular, in this speech synthesis device, the longer the segment length, the more it is possible to significantly reduce the concatenation distortion and the sound quality degradation accompanying prosody control.

On the other hand, in other sections, that is, in a non-central segment section, since a segment fitting the prosody information generated based on the central segment is selected, it is possible to avoid disturbance of prosody of the synthesized speech.

Figure 3:
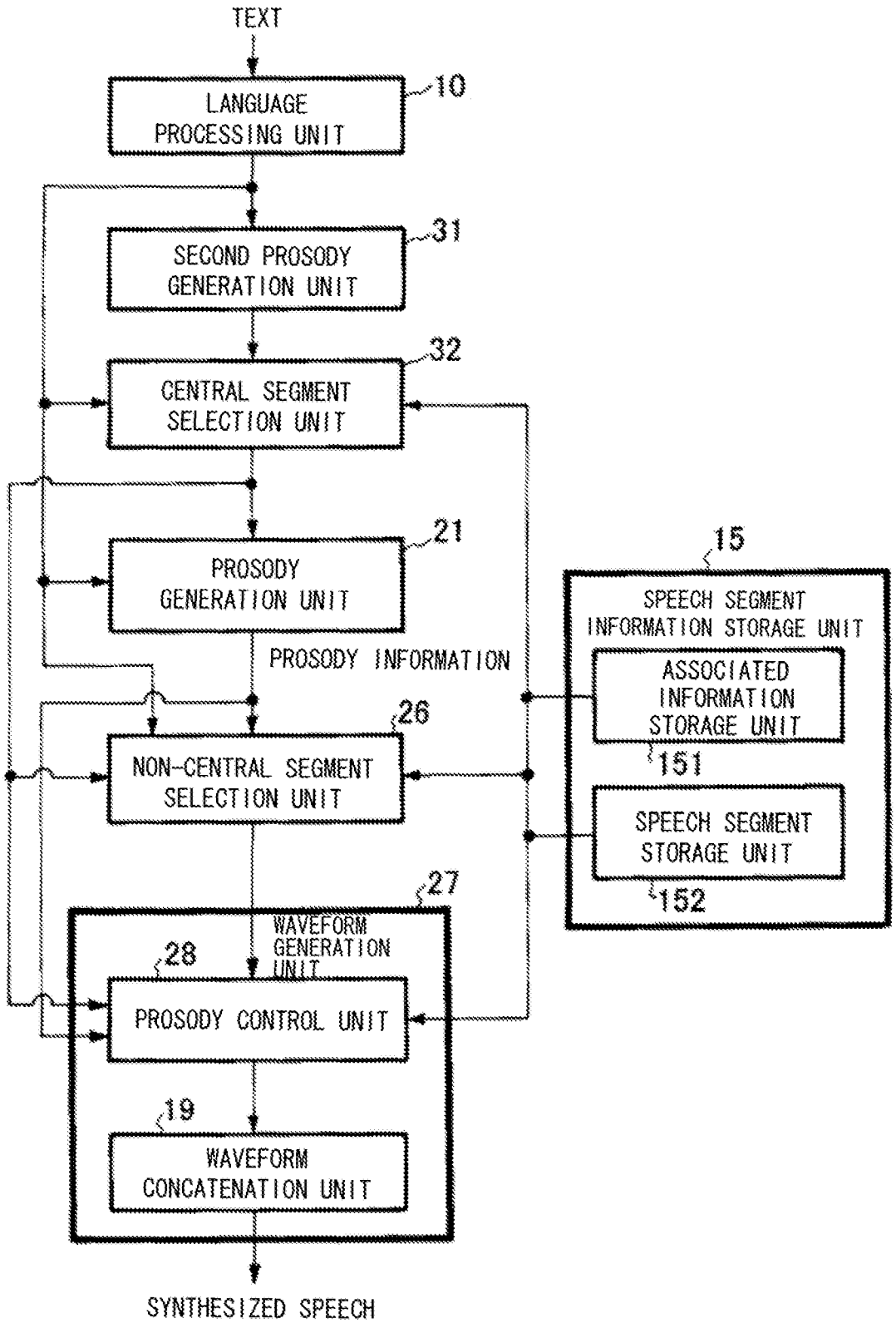
FIG. 3 is a block diagram showing a configuration of a speech synthesis device according to a second exemplary embodiment of the present invention.

(2) Speech Synthesis Device according to a Second Exemplary Embodiment (2-1) Configuration of a Speech Synthesis Device According to the Second Exemplary Embodiment FIG. 3 is a block diagram showing a configuration according to the second exemplary embodiment of the present invention.

In the configuration of the second exemplary embodiment shown in FIG. 3, central segment selection unit 22 of the first exemplary embodiment shown in FIG. 1 is replaced by central segment selection unit 32 and in addition is further provided with second prosody generation unit 31.

Focusing on these points of difference, a description is given below concerning detailed operation of the speech synthesis device according to the second exemplary embodiment, while referring to the block diagram of FIG. 3.

Figure 4:
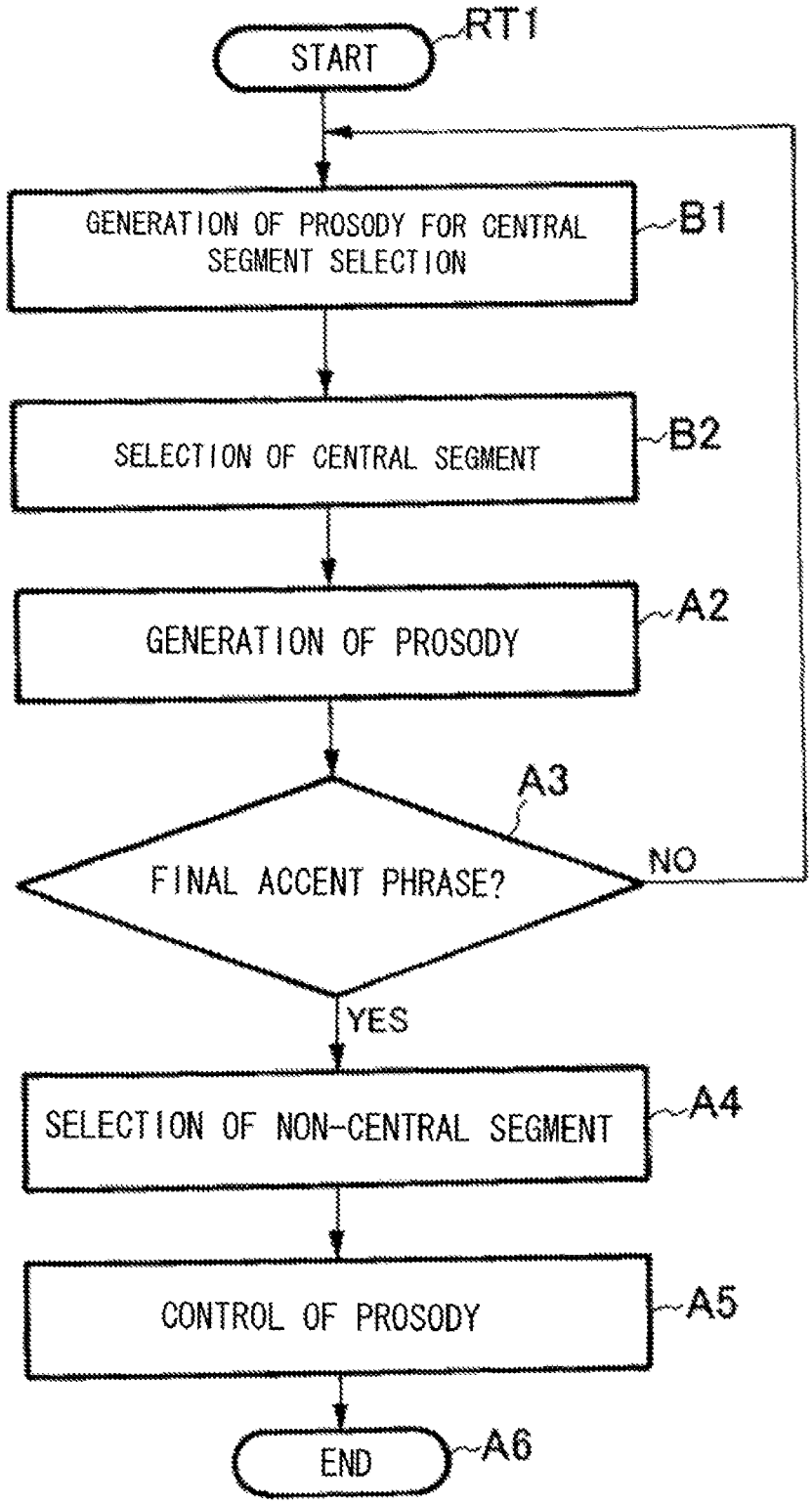
FIG. 4 is a flowchart for describing operation according to a second exemplary embodiment of the present invention.

(2-2) Operation of a Speech Synthesis Device According to the Second Exemplary Embodiment FIG. 4 is a flowchart for describing operation of the second exemplary embodiment of the present invention.

Referring to the flowchart of FIG. 4, second prosody generation unit 31 generates prosody information based on a language processing result supplied by language processing unit 10 and transmits the information to central segment selection unit 32 (step B1).

Since the prosody information generated in second prosody generation unit 31 is used in selection of a central segment, there is no necessity to match prosody information generated in prosody generation unit 21.

A most basic generation method is a method of generating prosody information in a similar manner as in prosody generation unit 11 of FIG. 9, and extracting from this a characteristic amount used in the central segment selection.

For example, in a case of generating pitch pattern, a method is cited in which pitch frequency in each accent phrase, and maximum pitch frequency within an accent phrase and the like are computed from the generated pitch pattern, and degree of similarity with a characteristic amount thereof is used in a central segment selection criterion.

Furthermore, in a case of generating time length, a method is cited in which an average speaking rate is used as a selection criterion.

Central segment selection unit 32 selects the central segment based on the language processing result supplied by language processing unit 10, speech segment information supplied by speech segment information storage unit 15, and prosody information supplied by second prosody generation unit 31, and transmits information concerning the selected central segment to prosody generation unit 21, non-central segment selection unit 26, and prosody control unit 28 (step B2).

Central segment selection unit 32, different from central segment selection unit 22 of FIG. 1, selects the central segment using the prosody information, in addition to degree of conformity with the language processing result and segment length.

For example, first, plural segments forming central segment candidates are prepared from the degree of conformity with the language processing result and the segment length, and an optimum central segment is selected with similarity with prosody information of each candidate as a selection criterion.

A method is cited in which a ratio of a highest pitch frequency of a candidate segment and a highest pitch frequency supplied by second prosody generation unit 31 is used as an indicator of a selection criterion.

Furthermore, in a case where the start point of an accent phrase is included in a candidate segment, a method of having a ratio of a pitch frequency of the start point of the candidate segment and a start point pitch frequency supplied by second prosody generation unit 31 as an indicator of a selection criterion is also effective.

In the same way, it is possible also to have a ratio or difference of an average time length of the candidate segment and an average time length supplied by second prosody generation unit 31 as an indicator.

Furthermore, in a case of using the prosody information as a selection criterion, similar to the degree of conformity with the language processing result, usage thereof as a constraint condition in selection of the central segment is desirable.

(2-3) Effects of a Speech Synthesis Device According to the Second Exemplary Embodiment According to the present exemplary embodiment, the speech synthesis device also uses prosody information in selection of the central segment, in addition to the language processing result and segment length.

As a result, in comparison to the first exemplary embodiment, quality of prosody information generated by the prosody generation unit is improved, and it is possible to reduce disturbance of prosody of synthesized speech.

Figure 5:
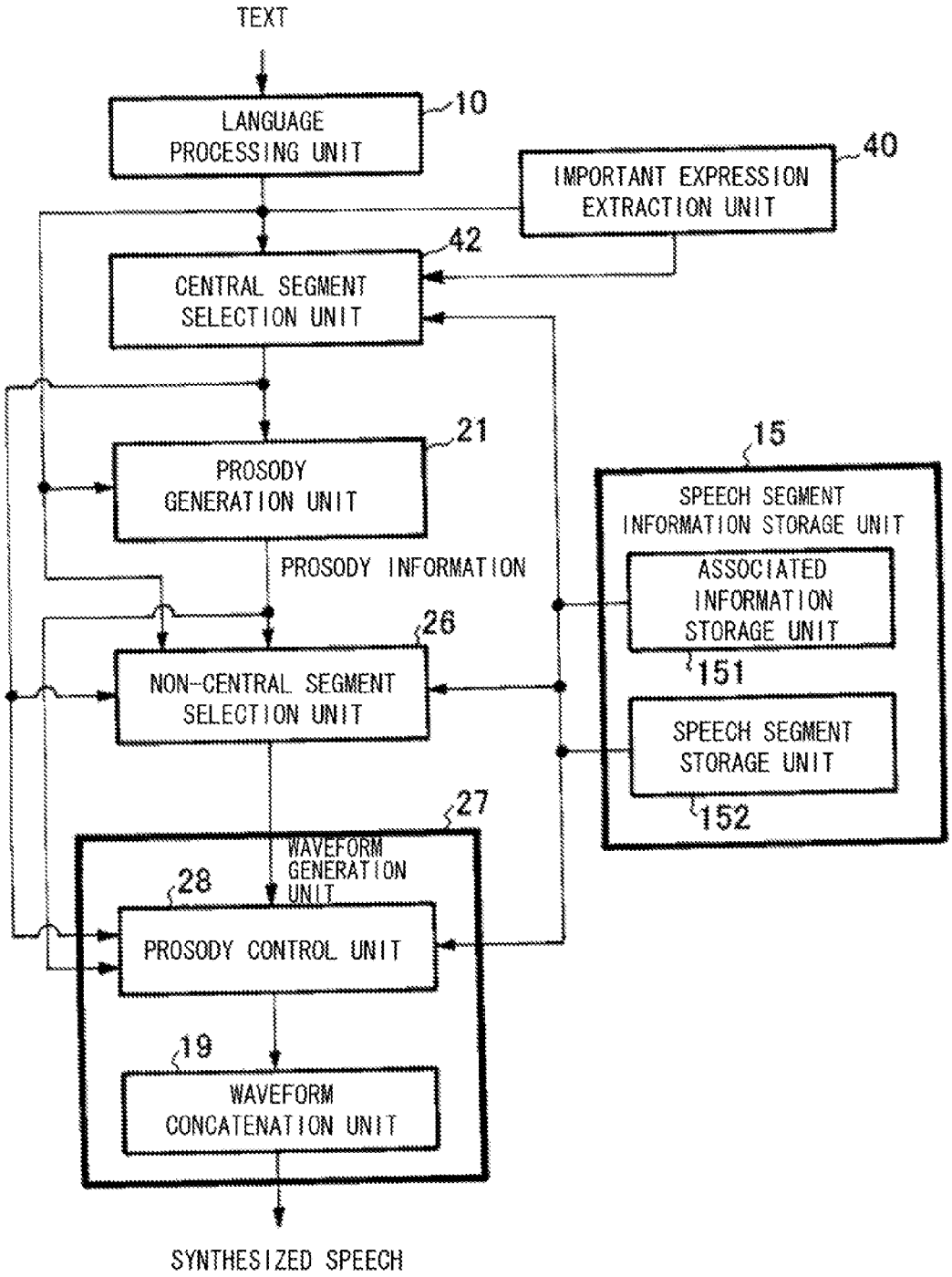
FIG. 5 is a block diagram showing a configuration of a speech synthesis device according to a third exemplary embodiment of the present invention.

(3) Speech Synthesis Device according to a Third Exemplary Embodiment (3-1) Configuration of a Speech Synthesis Device According to the Third Exemplary Embodiment FIG. 5 is a block diagram showing a configuration according to the third exemplary embodiment of the present invention.

In the configuration of the third exemplary embodiment shown in FIG. 5, central segment selection unit 22 of the first exemplary embodiment shown in FIG. 1 is replaced by central segment selection unit 42 and in addition is further provided with important expression extraction unit 40.

Focusing on these points of difference, a description is given below concerning detailed operation of the speech synthesis device according to the third exemplary embodiment, while referring to the block diagram of FIG. 5.

Figure 6:
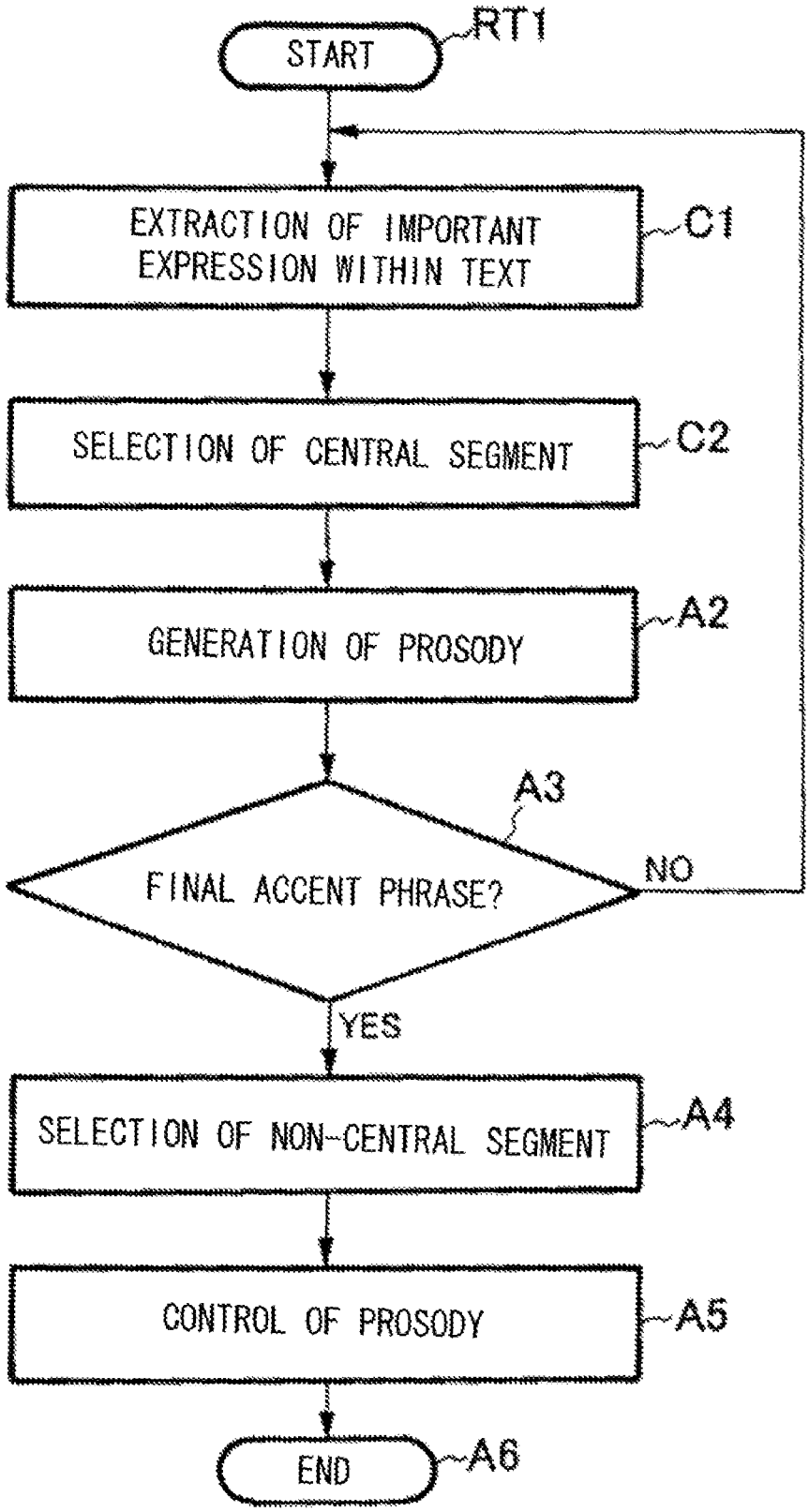
FIG. 6 is a flowchart for describing operation according to a third exemplary embodiment of the present invention.

(3-2) Operation of a Speech Synthesis Device According to the Third Exemplary Embodiment FIG. 6 is a flowchart for describing operation of the third exemplary embodiment of the present invention.

Referring to the flowchart of FIG. 6, important expression extraction unit 40 extracts an expression characterized by a keyword in inputted text, or meaning or impression of the input text, based on a language processing result supplied by language processing unit 10 and transmits the expression to central segment selection unit 42 (step C1).

An important word included in the text or an expression characterizing text content is extracted from the language processing result.

Furthermore, direct analysis of the input text and application to extraction of the important expression are also effective.

The important expressions are often different according to content of the input text.

For example, for content of weather forecast, words expressing the weather such as "fine, cloudy, rain", or a value of probability of precipitation may be cited as important expressions.

Therefore, if estimation of intention and content of the input text is performed in important expression extraction unit 40, extraction accuracy of the important expressions is improved.

Central segment selection unit 42 selects a central segment based on the language processing result supplied by language processing unit 10, speech segment information supplied by speech segment information storage unit 15, and important expression information supplied by important expression extraction unit 40, and transmits information concerning the selected central segment to prosody generation unit 21, non-central segment selection unit 26, and prosody control unit 28 (step C2).

Here, when searching for a central segment, if a segment matching an important expression exists, it is selected preferentially as the central segment even if segment length is short. In particular, in order to improve content comprehension of synthesized speech, preferentially making the important expression the central segment is effective.

(3-3) Effects of a Speech Synthesis Device According to the Third Exemplary Embodiment According to the present exemplary embodiment, the speech synthesis device uses the important expression selected from among input text, in addition to the language processing result and segment length.

As a result, in comparison with the first exemplary embodiment, it is possible to improve sound quality of locations of important words and expressions among speech content of synthesized speech, and to improve content comprehension of the synthesized speech.

Figure 7:
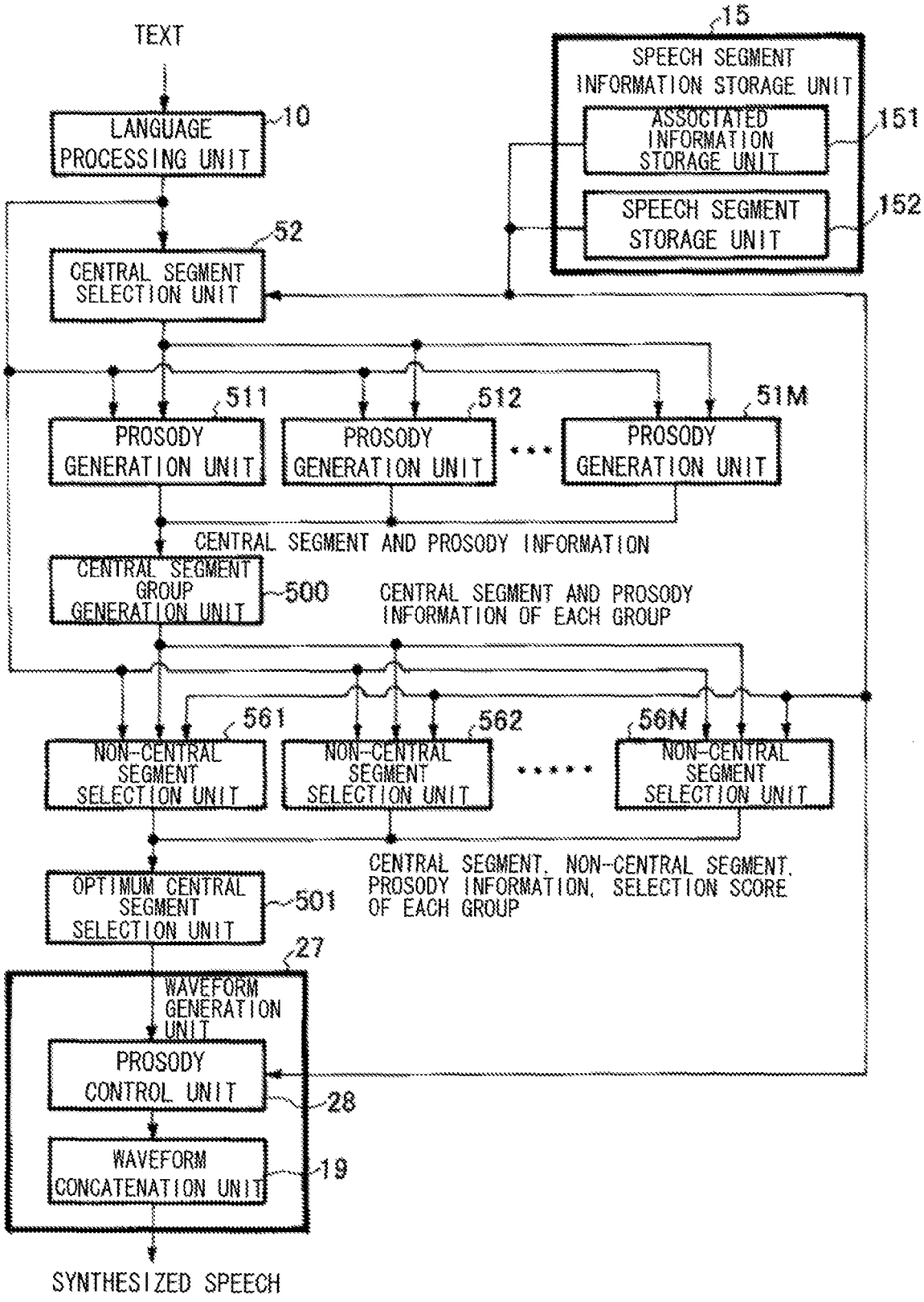
FIG. 7 is a block diagram showing a configuration of a speech synthesis device according to a fourth exemplary embodiment of the present invention.

(4) Speech Synthesis Device according to a Fourth Exemplary Embodiment (4-1) Configuration of a Speech Synthesis Device According to the Fourth Exemplary Embodiment FIG. 7 is a block diagram showing a configuration according to the fourth exemplary embodiment of the present invention.

In the configuration of the fourth exemplary embodiment shown in FIG. 7, central segment selection unit 22, prosody generation unit 21, and non-central segment selection unit 26 of the first exemplary embodiment shown in FIG. 1 are replaced by central segment candidate selection unit 52, prosody generation units 511, 512, . . . 51M, non-central segment selection units 561, 562, . . . 56N, and in addition central segment group generation unit 500 and optimum central segment selection unit 501 are further provided.

Focusing on these points of difference, a description is given below concerning detailed operation of the speech synthesis device according to the fourth exemplary embodiment, while referring to the block diagram of FIG. 7.

Figure 8:
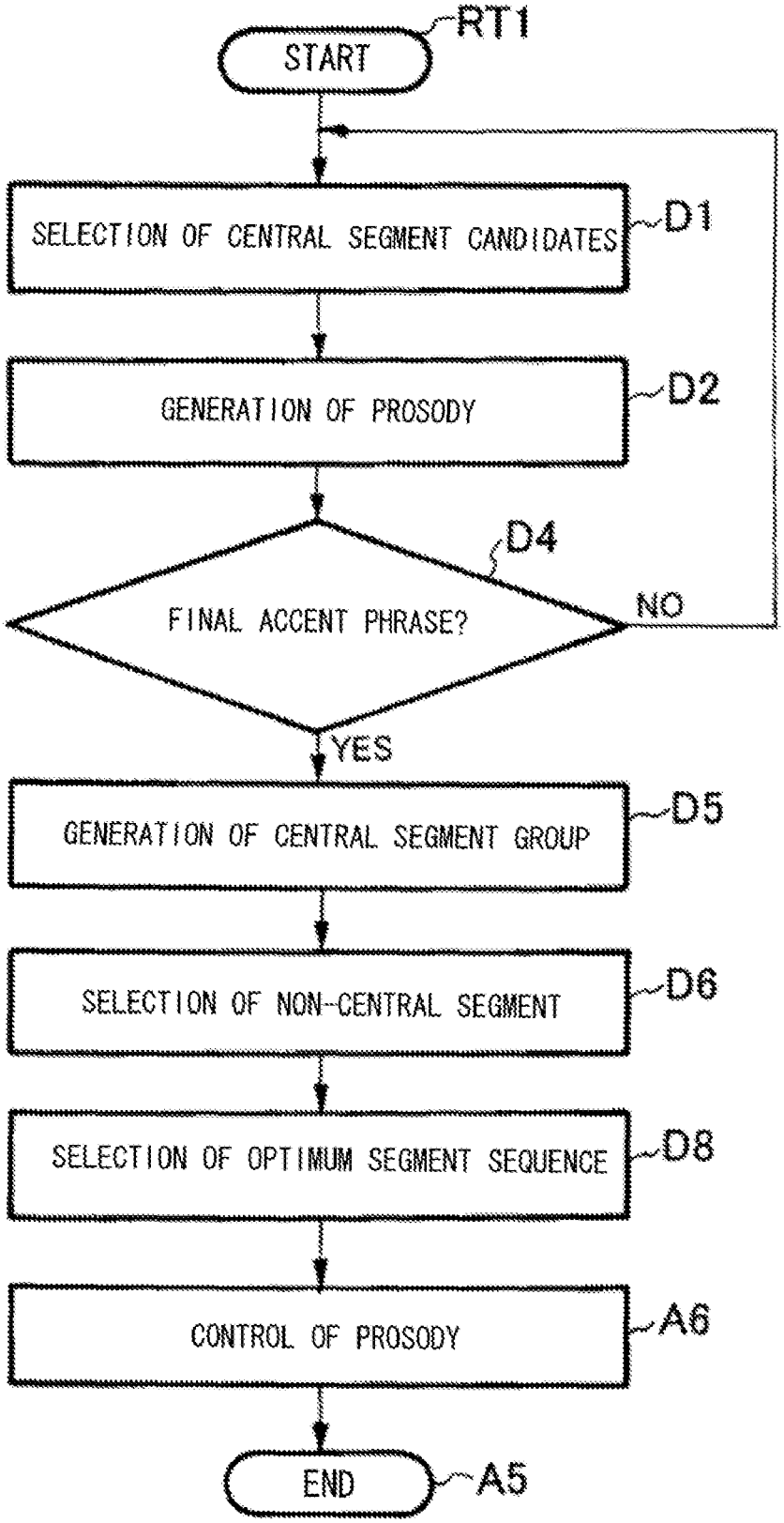
FIG. 8 is a flowchart for describing operation according to a fourth exemplary embodiment of the present invention.

(4-2) Operation of a Speech Synthesis Device According to the Fourth Exemplary Embodiment FIG. 8 is a flowchart for describing operation of the fourth exemplary embodiment of the present invention.

Referring to the flowchart of FIG. 8, central segment candidate selection unit 52 selects a plurality of candidate segments that could be a central segment based on a language processing result supplied by language processing unit 10 and speech information supplied by speech segment information storage unit 15 and transmits the segments to prosody generation units 511, 512, . . . 51M (step D1).

Here, in the first exemplary embodiment selection was made with the longest segment as a central segment, having the degree of conformity with the language processing result as a constraint condition, but in the present exemplary embodiment a plurality of central segment candidates are selected, while also having segment length as a selection criterion.

In this regard, selection is done with candidate segments, in order, from a longest segment, until the number of candidates satisfy a value determined in advance (M in the present exemplary embodiment).

However, if the candidate segments are simply selected, in order, from the longest segment, partial segments of a specific segment may form a large majority of the candidates.

For example, from a segment of length L, it is possible to select tow types of segment of length L-1, and three types of segment of length L-2.

Here, a segment of length of L-1 and a segment of length L-2 are referred to as partial segments of a segment of length L.

Since there is high probability of prosodies of partial segments of a certain segment (in the abovementioned example, the segment of length L-1 and the segment of length L-2) being similar, if many partial segments are adopted as candidate segments from segments having non-preferred prosodies, there is a high probability of an adverse effect being given to the quality of synthesized speech.

Therefore, in order to have various types of segment having different prosodies as central segment candidates, it is desirable to limit to some extent the number of types of partial segments.

In the present exemplary embodiment, the number of candidates is set at M, but selection of candidate segments as far as M need not necessarily be performed. That is, segments whose segment length is too short and that do not satisfy a criterion for a central segment are excluded from the candidates.

Prosody generation units 511, 512, . . . 51M generate prosody information based on the language processing result supplied by language processing unit 10 and a central segment supplied by central segment selection unit 52, and transmit the central segment and the prosody information to central segment group generation unit 500 (step D2).

In prosody generation units 511, 512, . . . 51M, respective prosody information is generated for each central segment candidate. A method of generating the prosody information is the same as for prosody generation unit 21 of FIG. 1.

The selection of the central segment and the generation of the prosody information as above are performed for each arbitrary section. In the present exemplary embodiment, a description is given concerning an example using an accent phrase as the section.

Therefore, before moving to generation of a central segment group, completion of the selection of the central segment candidates (step D1) and of the generation of the prosody information (step D2), with regard to all accent phrases, is confirmed (step D4).

Central segment group generation unit 500 generates the central segment group based on the prosody information and the central segments supplied by prosody generation units 511, 512, . . . 51M, and transmits the prosody information and the central segments of each generated group to non-central segment selection units 561, 562, . . . 56N (step D5).

Here, in the present exemplary embodiment a description is given concerning an example of performing computation of unit cost and concatenation cost for each breath group. In this case, selection of a non-central segment is performed not for accent phrase units but for breath group units, from the necessity to compute the unit cost and the concatenation cost.

Therefore, as in the present exemplary embodiment, in a case where plural central segments are cited as candidates for each accent phrase, there exist a plurality of combinations of central segments that can be considered in formation of breath groups.

For example, with regard to breath groups formed by two accent phrases, in a case where there are three central segment candidates in a first accent phrase, and there are two central segment candidates in a second accent phrase, there are six combinations of central segment candidates.

In order to implement segment selection for all the combinations of central segment candidates (six in this example), in central segment group generation unit 500, all the central segment combinations are generated, a group number is given to each combination, and is transmitted together with the prosody information and the central segment to each non-central segment selection unit.

A value of N corresponds to the number of all the central segment candidate combinations, and the value of N changes according to values of the number of accent phrases included in breath groups and the number of central segment candidates of each accent phrase.

Non-central segment selection units 561, 562, . . . 56N select non-central segments based on the language processing result supplied by language processing unit 10, speech segment information supplied by speech segment information storage unit 15, and prosody information and central segments of each central segment group supplied by central segment group generation unit 500, and transmits prosody information, central segments, and non-central segment of each group, and segment selection cost obtained when a non-central segment is selected, to optimum central segment selection unit 501 (step D6).

A method of computing cost and a method of selecting segments of a non-central section are the same as for a non-central segment selection unit 26 of FIG. 1.

Optimum segment selection unit 501 selects an optimum combination of central segment and non-central segment, based on the segment selection cost of each group supplied by non-central segment selection units 561, 562, . . . 56N and transmits the combination together with the prosody information to prosody control unit 28 (step D8).

Since it is considered that the lower the segment selection cost, the higher the quality of the synthesized speech becomes, a central segment and non-central candidates of a group for which the segment selection cost is minimum are selected as the optimum segments.

(4-3) Effects of a Speech Synthesis Device According to the Fourth Exemplary Embodiment According to the present exemplary embodiment, the speech synthesis device selects a plurality of central segment candidates, and with respect to each of the candidates, generates the prosody information and performs selection of the non-central segment. The optimum central segment and non-central segment are selected based on the selection cost of the non-central segment.

That is, there is a characteristic in that the selection cost of the non-central segment is used in selection of the central segment.

As a result, in comparison to the first exemplary embodiment, it is possible to select a central segment linked to quality improvement of non-central segment sections, and overall quality of the synthesized speech is improved.

(5) Concerning Other Exemplary Embodiments

Embodiments according to the present invention are not limited to the speech synthesis devices described in the first exemplary embodiment to the fourth exemplary embodiment, and configurations and operations thereof can be changed as appropriate, within bounds that do not depart from the spirit of the invention.

Furthermore, the exemplary embodiments according to the present invention have been described focusing on configurations and operation of the invention, but functions or procedures of the embodiments according to the present invention may be realized and executed by a computer-readable program.

The abovementioned present invention has been described according to the abovementioned exemplary embodiments but the present invention is not limited to only the abovementioned embodiments and clearly includes every type of transformation and modification that a person skilled in the art can realize within the scope of the invention as in the respective claims of the present application.

In the present invention, there are a variety of modes as follows.

Mode 1: as set forth as the first aspect.

Modes 2-12 directed to the speech synthesis device: as set forth in original claims 2-12, respectively.

Mode 13: as set forth as the second aspect.

Modes 14-15 directed to the speech synthesis method: as set forth in original claims 14-15, respectively.

Mode 16. A speech synthesis method for a speech synthesis device, the method comprising:

a central segment selection step of selecting a plurality of central segments from among a plurality of speech segments;

a prosody generation step of generating prosody information for each central segment based on the central segments;

a non-central segment selection step of selecting a non-central segment, which is a segment outside of a central segment section, for each central segment based on the central segments and the prosody information;

an optimum central segment selection step of selecting an optimum central segment from among the plurality of central segments; and a waveform generation step of generating a synthesized speech waveform based on the optimum central segment, prosody information generated based on an optimum central segment, and a non-central segment selected based on an optimum central segment.

Mode 17. The speech synthesis method according to mode 16, wherein the central segment selection step preferentially selects a speech segment having a long segment length as a central segment.

Mode 18. The speech synthesis method according to mode 16, wherein the central segment selection step selects a speech segment from among the plurality of speech segments as a central segment in order of segment length.

Mode 19. The speech synthesis method according to mode 18, wherein the central segment selection step arranges that a speech segment selected as a central segment does not include a partial segment of itself.

Mode 20. The speech synthesis method according to any one of modes 16 to 19, wherein the optimum central segment selection step selects an optimum central segment according to a selection result of the non-central segment selection step.

Mode21. The speech synthesis method according to any one of modes 16 to 19, wherein the optimum central segment selection step selects an optimum central segment according to segment selection cost for each respective central segment computed in the non-central segment selection step.

Modes 22-24 directed to the speech synthesis method.

Mode 25. directed to a speech synthesis program: as set forth as the third aspect.

Mode 26. The speech synthesis program according to mode 25, wherein the central segment selection unit preferentially selects a speech segment having a long segment length as a central segment.

Mode 27. The speech synthesis program according to mode 25, wherein the central segment selection unit selects a speech segment having the longest segment length as a central segment.

Mode 28. A speech synthesis program for a speech synthesis device, the program causing a computer to function as:

a central segment selection unit for selecting a plurality of central segments from among a plurality of speech segments;

a prosody generation unit for generating prosody information for each central segment based on the central segments;

a non-central segment selection unit for selecting a non-central segment, which is a segment outside of a central segment section, for each central segment based on the central segments and the prosody information;

an optimum central segment selection unit for selecting an optimum central segment from among the plurality of central segments; and a waveform generation unit for generating a synthesized speech waveform based on the optimum central segment, prosody information generated based on an optimum central segment, and a non-central segment selected based on an optimum central segment.

Mode 29. The speech synthesis program according to mode 28, wherein the central segment selection unit preferentially selects a speech segment having a long segment length as a central segment.

Mode 30. The speech synthesis program according to mode 28, wherein the central segment selection unit selects a speech segment from among the plurality of speech segments as a central segment in order of segment length.

Mode 31. The speech synthesis program according to mode 30, wherein the central segment selection unit arranges that a speech segment selected as a central segment does not include a partial segment of itself.

Mode 32. The speech synthesis program according to any one of modes 28 to 31, wherein the optimum central segment selection unit selects an optimum central segment according to a selection result of the non-central segment selection unit.

Mode33. The speech synthesis program according to any one of modes 28 to 31, wherein the optimum central segment selection unit selects an optimum central segment according to segment selection cost computed for each respective central segment by the non-central segment selection unit.

Mode 34. The speech synthesis program according to any one of modes 25 to 33, wherein the central segment selection unit comprises a language processing unit for performing language processing of input text, and selects a central segment from among a plurality of speech segments that have a high degree of conformity with a language processing result of the language processing.

Mode 35. The speech synthesis program according to mode 34, wherein the central segment selection unit comprises a prosody generation unit for generating prosody information based on the language processing result, and selects a central segment based on the prosody information.

Mode 36. The speech synthesis program according to mode 34 or 35, wherein the central segment selection unit further comprises an important expression extraction unit for extracting an important expression included in input text based on the language processing result, and selects a central segment based on the important expression.

Modifications and adjustments of embodiments and examples are possible within bounds of the entire disclosure (including the claims) of the present invention, and also based on fundamental technological concepts thereof. Furthermore, a wide variety of combinations and selections of various disclosed elements are possible within the scope of the claims of the present invention.

What is claimed is:

1. A speech synthesis device comprising:

A language processing unit for performing language processing of input text;

a central segment selection unit for selecting a central segment from among a plurality of speech segments based on the language processing result;

a prosody generation unit for generating prosody information based on the central segment and the language processing result;

a non-central segment selection unit for selecting a non-central segment, based on the central segment and the generated prosody information; and a waveform generation unit for generating a synthesized speech waveform based on the central segment, and the non-central segment, wherein the prosody generation unit generates prosody information of the non-central segment, based on the prosody information of the central segment and the language processing result.

2. The speech synthesis device according to claim 1, wherein the central segment selection unit preferentially selects a speech segment having a long segment length as a central segment.

3. The speech synthesis device according to claim 1, wherein the central segment selection unit selects a speech segment having the longest segment length as a central segment.

4. The speech synthesis device according to claim 1, wherein the central segment selection unit selects a central segment from among a plurality of speech segments that have a high degree of conformity with a language processing result of the language processing.

5. The speech synthesis device according to claim 4, wherein the central segment selection unit comprises a second prosody generation unit for generating second prosody information based on the language processing result, and selects a central segment based on the second prosody information.

6. The speech synthesis device according to claim 4, wherein the central segment selection unit further comprises an important expression extraction unit for extracting an important expression included in input text based on the language processing result, and selects a central segment based on the important expression.

7. A speech synthesis device comprising:

a central segment selection unit for selecting a plurality of central segments from among a plurality of speech segments;

a prosody generation unit for generating prosody information for each central segment based on the central segments;

a non-central segment selection unit for selecting a non-central segment, which is a segment outside of a central segment section, for each central segment based on the central segments and the prosody information;

an optimum central segment selection unit for selecting an optimum central segment from among the plurality of central segments; and a waveform generation unit for generating a synthesized speech waveform based on the optimum central segment, prosody information generated based on an optimum central segment, and a non-central segment selected based on an optimum central segment.

8. The speech synthesis device according to claim 7, wherein the central segment selection unit preferentially selects a speech segment having a long segment length as a central segment.

9. The speech synthesis device according to claim 7, wherein the central segment selection unit selects a speech segment from among the plurality of speech segments as a central segment in order of segment length.

10. The speech synthesis device according to claim 9, wherein the central segment selection unit arranges that a speech segment selected as a central segment does not include a partial segment of itself.

11. The speech synthesis device according to claim 7, wherein the optimum central segment selection unit selects an optimum central segment according to a selection result of the non-central segment selection unit.

12. The speech synthesis device according to claim 7, wherein the optimum central segment selection unit selects an optimum central segment according to segment selection cost for each respective central segment computed by the non-central segment selection unit.

13. A speech synthesis method for a speech synthesis device, the method comprising:

performing language processing of input text;

selecting a central segment from among a plurality of speech segments based on the language processing result;

generating prosody information based on the selected central segment;

selecting a non-central segment based on the central segment and the generated prosody information; and generating a synthesized speech waveform based on the central segment, and the non-central segment, wherein generating prosody information of the non-central segment is based on the prosody information of the central segment and the language processing result.

14. The speech synthesis method according to claim 13, wherein said selecting the central segment preferentially selects a speech segment having a long segment length as a central segment.

15. The speech synthesis method according to claim 13, wherein said selecting the central segment selects a speech segment having the longest segment length as a central segment.

16. The speech synthesis method according to claim 13, wherein said selecting the central segment selects a central segment from among a plurality of speech segments that have a high degree of conformity with a language processing result of the language processing.

17. The speech synthesis method according to claim 16, wherein said selecting the central segment includes generating second prosody information based on the language processing result, and selects a central segment based on the second prosody information.

18. The speech synthesis method according to claim 16, wherein said selecting the central segment further includes extracting an important expression included in input text based on the language processing result, and selects a central segment based on the important expression.

* * * * *